US009279401B2

(12) United States Patent
Rogler

(10) Patent No.: US 9,279,401 B2
(45) Date of Patent: Mar. 8, 2016

(54) INJECTION DEVICE HAVING REDUCED PRESSURE OSCILLATIONS

(75) Inventor: Philipp Rogler, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 865 days.

(21) Appl. No.: 13/574,433

(22) PCT Filed: Dec. 7, 2010

(86) PCT No.: PCT/EP2010/069030

§ 371 (c)(1),
(2), (4) Date: Oct. 4, 2012

(87) PCT Pub. No.: WO2011/088928

PCT Pub. Date: Jul. 28, 2011

(65) Prior Publication Data

US 2013/0037631 A1 Feb. 14, 2013

(30) Foreign Application Priority Data

Jan. 25, 2010 (DE) ..... 10 2010 001 170

(51) Int. Cl.

| | |
|---|---|
| ***F01N 3/00*** | (2006.01) |
| ***B05B 1/30*** | (2006.01) |
| ***F02M 55/02*** | (2006.01) |
| ***F02M 69/46*** | (2006.01) |

(52) U.S. Cl.

CPC ..... *F02M 55/02* (2013.01); *F02M 69/462* (2013.01); *F02M 2200/28* (2013.01); *F02M 2200/315* (2013.01)

(58) Field of Classification Search

CPC ..... F01N 3/00; B05B 1/30
USPC ..... 239/569, 584; 60/303
See application file for complete search history.

(56) References Cited

U.S. PATENT DOCUMENTS

| | | | | |
|---|---|---|---|---|
| 6,244,250 | B1 * | 6/2001 | Hlousek | 123/467 |
| 2002/0084356 | A1 * | 7/2002 | Dallmeyer et al. | 239/575 |
| 2003/0160118 | A1 * | 8/2003 | Schmauser | 239/585.1 |
| 2004/0060998 | A1 * | 4/2004 | Stoecklein et al. | 239/102.2 |
| 2005/0263135 | A1 * | 12/2005 | Magel et al. | 123/467 |
| 2010/0102143 | A1 * | 4/2010 | Magel | 239/124 |
| 2010/0181392 | A1 * | 7/2010 | Melzer et al. | 239/533.3 |

FOREIGN PATENT DOCUMENTS

| | | | | |
|---|---|---|---|---|
| CN | 101331312 | | 12/2008 | |
| CN | 101387251 | | 3/2009 | |
| CN | 101523043 | | 9/2009 | |
| DE | 10 2005 022698 | | 11/2006 | |
| DE | WO2008/141918 | * | 11/2008 | F02M 47/02 |
| EP | 1 503 073 | | 2/2005 | |
| FR | 2 886 350 | | 12/2006 | |
| WO | 2007/012092 | | 2/2007 | |

* cited by examiner

*Primary Examiner* — Arthur O Hall
*Assistant Examiner* — Chee-Chong Lee
(74) *Attorney, Agent, or Firm* — Kenyon & Kenyon LLP

(57) ABSTRACT

An injection device for injecting fuel, including a fuel supply path, through which fuel is able to be supplied, an injector having a spray orifice, from which the supplied fuel is ejected, a valve element, which is movable using an actuator, for opening the spray orifice and for closing it, and a throttle, which is situated in the fuel supply path, a distance of the throttle from the spray orifice along the fuel path having a length which is equivalent to the wavelength of a characteristic frequency of the injection device.

11 Claims, 1 Drawing Sheet

INJECTION DEVICE HAVING REDUCED PRESSURE OSCILLATIONS

FIELD OF THE INVENTION

The present invention relates to an injection device having reduced pressure oscillations during the injection process.

BACKGROUND INFORMATION

Injection devices in diversified embodiments are understood to be in the related art. Such injection devices have a valve element that is able to be operated by an actuator, e.g. a valve needle, which opens an injection hole for an injection and closes it again after the injection. Based on the pressure oscillations in the fuel, occurring in the process, inaccuracies may come about in fuel metering, and undesired noises may appear in addition. The fuel begins to flow out when the valve is opened, so that the pressure in the vicinity of the valve seat drops off. Since the remaining fuel quantity, that is located in the injection device, is first of all still at rest at a higher pressure level, this pressure breakdown continues in the form of a pressure wave upstream, through the fuel supply path. This pressure wave is reflected at cross sectional change locations or projections, and a pressure wave system develops within the valve.

Consequently, based on these pressure oscillations, the pressure gradient between the valve seat and the surroundings, e.g. the intake manifold or the combustion chamber, changes as well, as a function of time. In the case of a fully opened valve this leads to an injection rate that is not constant over time, which impairs the metering accuracy. Furthermore, the pressure oscillations may also have a disadvantageous effect on the geometry of the fuel spray, as well as the diameter of the drops in the spray. In addition, based on the pressure fluctuations in the fuel spray, richer and leaner zones may be created, whereby the combustion and also the exhaust gas behavior may be impaired. Besides the problems with the metering accuracy, the pressure oscillations also lead to undesired noises, and may cause damage to the components, in the long run. From all this, it would be desirable to have an injection device that had the highest requirement on metering accuracy and behavior with respect to noise.

SUMMARY OF THE INVENTION

By contrast the injection device according to the exemplary embodiments and/or exemplary methods of the present invention, for injecting a medium having the features described herein, has the advantage that undesired pressure waves in the system are damped to the greatest extent, so that no disadvantageous effects on metering accuracy occur, and no undesired development of noise takes place. Consequently, according to the exemplary embodiments and/or exemplary methods of the present invention, fluctuations in the injection rate and undesired changes with time in the spray geometry may be avoided during injection. This is achieved, according to the exemplary embodiments and/or exemplary methods of the present invention, in that the injection device has a throttle, the distance of the throttle from an injection hole of the injection device along a medium path having a length that corresponds to the wavelength of a natural frequency of the injection device.

Consequently, according to the exemplary embodiments and/or exemplary methods of the present invention, a natural frequency of the injection device is determined, and then the throttle is positioned in the medium path in such a way that the distance of the throttle from the spray orifice is equivalent to the wavelength of the natural frequency. An excellent damping can be achieved by this, so that the pressure waves created when the injection device is opened have no negative effects, particularly with respect to metering accuracy and noise emission.

The further developments of the present invention are also described herein.

In an especially particular manner, the throttle is situated in the injection device. In this connection, the construction of the injection device is so that the injection device has a natural frequency so that the throttle is able to be positioned in the injection device.

In order to make possible as simple a manufacturability as possible, the throttle is provided as a separate component.

According to one alternative embodiment of the present invention, the throttle is integrated into a component of the medium path, for instance, a housing component. The number of components may thereby be reduced.

Furthermore, the throttle may be configured so that it has a ratio of length to passage diameter LID of 0.01 to 100, 1 to 5, and especially 2 to 3. The passage diameter, in this instance, is the minimum passage cross section of the throttle. Excellent damping is achievable especially when the ratio of length to passage diameter is between 2 and 3.

In a further manner, the throttle is developed symmetrically to a center axis and or symmetrically to a plane perpendicular to the center axis. This geometrical form also provides great damping.

In a further manner, the throttle has a wide bevel at the inflow end and the outflow end. Thereby a favorable flow through the throttle is able to be achieved. Particularly, the bevels at the inflow end and the outflow end are developed conically and, further, equally.

In order to have the fewest possible rapid changes in cross section, the medium supply path may be configured essentially as a straight line between the spray orifice and the throttle. According to the exemplary embodiments and/or exemplary methods of the present invention, by the expression "essentially as a straight line" one should understand a medium path whose direction of flow does not change or changes only slightly. Thus, the medium path has no large flow diversions. In the case of this form as a straight line, as much as possible, of the medium supply path between the spray orifice and the throttle, excellent damping may be achieved.

The injection device according to the present invention may be used for various applications, such as direct injection or channel injection. Furthermore, the injection device according to the present invention is also independent of the medium, and may be applied both for Diesel and gasoline or in exhaust gas aftertreatment, e.g. additional water injection for $NO_x$ reduction in large Diesels, etc. In addition, the shape of the valve element of the injection device may be freely selected, and is, for instance, a valve needle or a valve ball.

An exemplary embodiment of the present invention is described in detail below, with reference to the accompanying drawings.

DETAILED DESCRIPTION

Figure 1:
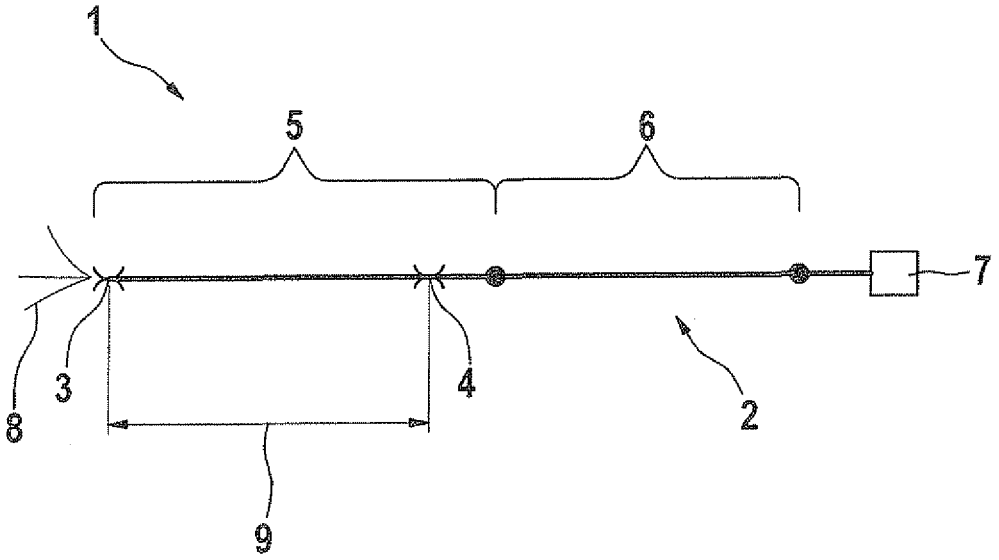
FIG. 1 shows a schematic representation of an injection device according to an exemplary embodiment of the present invention.
Figure 2:
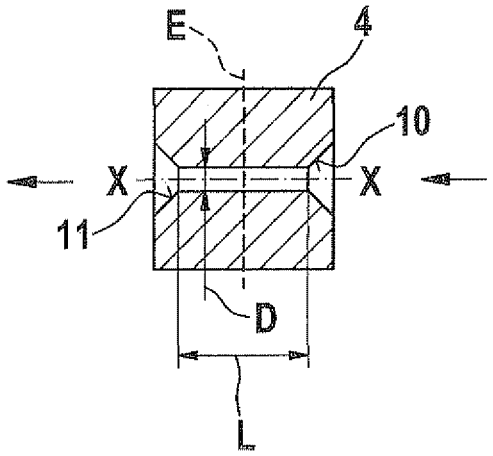
FIG. 2 shows a schematic sectional view of a throttle of the injection device of FIG. 1.

With reference to FIGS. 1 to 2, an injection device 1 for fuel injection according to an exemplary embodiment of the present invention is described in detail below.

As may be seen in FIG. 1, injection device 1 includes an injector 5 (injection valve) which is connected to a pump 7 via a rail 6. A continuous fuel path 2 is provided from the pump to a spray orifice on injector 5. When the valve is open, a spray 8 exits from spray orifice 3. Moreover, injection device 1 includes a throttle 4, which is situated in fuel path 2.

In this context, throttle 4 is positioned at a position in the fuel path which corresponds to the wavelength of a natural frequency of injection device 1. The distance from spray orifice 3 to throttle 4 is shown in FIG. 1 by reference numeral 9. Thus, to determine the position of the throttle, natural frequency the entire injection device 1 is first determined, and its wavelength is ascertained. Then throttle 4 is positioned in the fuel path at a position which corresponds to the wavelength of the natural frequency.

By doing this, oscillations created by opening spray orifice 3 are able to be damped effectively. In this exemplary embodiment, throttle 4 is situated in injector 5. However, as a function of the natural frequency of injection device 1, throttle 4 could also be situated at a position outside the injector, for instance, in rail 6. In the determination of the natural frequency of injection device 1, an operating state of the injection device is selected which corresponds to the later conditions of use. If, for example, the injection device is to be used for a Diesel vehicle, a standardized Diesel fuel is used and a temperature customary during operation is established, and then the natural frequency of the injection device is determined at this temperature. By doing this, the state close to the operation of the injection device is simulated in determining the natural frequency, so that the throttle may be situated at the correct position in fuel supply path 2. Thus, the positioning of the throttle is carried out in each case separately for various fuel types and also for various application purposes, that is, for different vehicle types. In order to be able to use as much as possible a standardized injector, the throttle may be situated in the injector in such a way that is position is easily changeable, and can then be fixed at the correct position. This may be done, for instance, by providing a sleeve in which the throttle is situated displaceably. When the throttle is then situated at the appropriate position, it may be fixed, for example, by welding.

FIG. 2 shows a sectional view of throttle 4. In this exemplary embodiment, throttle 4 is developed both symmetrically to a center axis X-X and symmetrically to a plane E, which is perpendicular to center axis X-X. The arrows in FIG. 2 indicate the flow-through direction, in this context. In this instance, both at the inflow end and at the outflow end a wide bevel 10 and 11 are developed, which make possible a favorable flow-through of throttle 4. Bevels 10, 11 are developed to be conical in this context, and have the same geometry.

Consequently, according to the exemplary embodiments and/or exemplary methods of the present invention, the idea is taken up, for the first time, of undertaking the positioning the throttle as a function of the natural frequency of the system. Surprisingly, excellent damping properties come about from this idea, so that the injection devices according to the present invention achieve superb operating results with respect to metering accuracy and behavior with respect to noise, at only slight additional expenditure.

What is claimed is:

1. An injection device for injecting a medium, comprising:
- a medium supply path, through which a medium is able to be supplied;
- an injector having a spray orifice, from which the supplied medium is sprayed out;
- a valve element, which is movable using an actuator, to open the spray orifice and to close it; and
- a throttle situated in the medium supply path;
- wherein a distance of the throttle from the spray orifice along the medium supply path has a length which is equivalent to a wavelength of a natural frequency of the injection device.

2. The injection device of claim 1, wherein the throttle is situated in the injector.

3. The injection device of claim 1, wherein the throttle is a separate component.

4. The injection device of claim 1, wherein the throttle is integrated into a component of the medium path.

5. The injection device of claim 1, wherein the throttle has a ratio of length to a passage diameter, which is between 0.01 to 100.

6. The injection device of claim 1, wherein the throttle is developed symmetrically to at least one of a center axis and a plane that is perpendicular to the center axis.

7. The injection device of claim 1, wherein at one inflow end and at one outflow end the throttle has a wide bevel.

8. The injection device of claim 1, wherein the medium supply path runs essentially as a straight line between the spray orifice and the throttle.

9. An injection device for injecting fuel or water for exhaust gas aftertreatment, comprising:
- at least one of a fuel supply path and a water supply path, through which at least one of a fuel and water is able to be supplied;
- an injector having a spray orifice, from which at least one of the supplied fuel and the supplied water is sprayed out;
- a valve element, which is movable using an actuator, to open the spray orifice and to close it; and
- a throttle situated in at least one of the fuel supply path and the water supply path;
- wherein a distance of the throttle from the spray orifice along at least one of the fuel supply path and the water supply path has a length which is equivalent to a wavelength of a natural frequency of the injection device.

10. The injection device of claim 1, wherein the throttle has a ratio of length to a passage diameter, which is between 1 to 5.

11. The injection device of claim 1, wherein the throttle has a ratio of length to a passage diameter, which is between 2 and 3.

* * * * *